United States Patent [19]

Sapinski

[11] Patent Number: 5,056,283

[45] Date of Patent: Oct. 15, 1991

[54] ADJUSTABLE STAIR RAIL

[75] Inventor: Thomas A. Sapinski, Jacksonville, Fla.

[73] Assignee: Visador Company, Jacksonville, Fla.

[21] Appl. No.: 533,928

[22] Filed: Jun. 6, 1990

[51] Int. Cl.[5] ..... E04F 11/00

[52] U.S. Cl. ..... 52/184; 256/65; 256/67

[58] Field of Search ..... 52/184, 730, 298; 656/22, 65 X, 67 X; 403/243, 263

[56] References Cited

U.S. PATENT DOCUMENTS

| | | | |
|---|---|---|---|
| 3,289,381 | 12/1966 | Blum et al. . | |
| 3,626,438 | 12/1971 | Cornell | 52/183 X |
| 3,804,374 | 4/1974 | Thom | 256/65 |
| 4,112,195 | 9/1978 | Pott et al. . | |
| 4,138,094 | 2/1979 | Thir | 52/298 X |
| 4,272,061 | 6/1981 | Suckno | 256/22 X |
| 4,344,604 | 8/1982 | Basey . | |
| 4,352,485 | 10/1982 | Basey . | |
| 4,403,767 | 9/1983 | Basey | 403/292 X |
| 4,408,749 | 10/1983 | Zieg | 403/168 X |
| 4,421,302 | 12/1983 | Grimm et al. | 256/65 X |
| 4,505,456 | 3/1985 | Zieg | 403/89 X |
| 4,533,121 | 8/1985 | Basey | 256/59 X |
| 4,642,953 | 2/1987 | DeGood . | |
| 4,893,442 | 1/1990 | Graham et al. | 52/184 |

*Primary Examiner*—David A. Scherbel
*Assistant Examiner*—Creighton Smith
*Attorney, Agent, or Firm*—Arthur G. Yeager

[57] ABSTRACT

An assembly of a hand rail, a shoe rail, a plurality of parallel balusters joined to the hand rail and the shoe rail through a pair of intermediate plastic webs attached both to the baluster and the adjacent rail so that the rails and balusters can be moved to any angular disposition keeping the balusters parallel to each other and the hand rail and shoe rail parallel to each other. The plastic webs include spaced tabs which are attached to each baluster end and provide total collapsibility to the rail section which is universal in use to any rake of the stair.

20 Claims, 3 Drawing Sheets

ADJUSTABLE STAIR RAIL

BACKGROUND OF THE INVENTION

Railings for stairs have been well-known for as long as there have been residences of more than one level joined by stair steps. Generally, the stair rail includes a hand rail attached to a newell post at each end of the stairs, and a plurality of spaced vertical balusters are attached at their upper ends to the hand rail, and at their lower ends to the stair steps. More recent designs have included a shoe rail attached to the lower ends of the balusters, so that an entire stair rail section can be prefabricated and brought into the building and incorporated in place as a unit, rather than to custom fit each baluster to steps at different levels. Even this type of prefabrication necessitated the construction of each stair rail section as a unique unit because of the fact that stair steps are constructed with an infinite selection of pitches, i.e., the angle between horizontal and the line of rise or fall of the stairs. In still more recent times there have been offered designs which can be adjusted to any pitch and secured in place. These designs provide a single construction unit which is usable for any stair design. Typical of such designs are those in U.S. Pat. Nos. 3,626,438; 3,804,374; 4,138,094; 4,403,767; 4,408,749; 4,421,302; 4,505,456; and 4,533,121. While these designs are operable for the intended purpose they are much more complicated than is necessary.

It is an object of this invention to provide a novel adjustable stair rail section. It is another object of this invention to provide an adjustable stair rail section that is simple and inexpensive to construct. A specific object is the provision of a stair rail section which is easily and totally collapsible for ready shipping and/or storage. Another specific object is to provide an improved stair rail section which is universally adaptable to any rake of stair or useable on a horizontal platform. Still other objects will become apparent from the more detailed description which follows.

BRIEF SUMMARY OF THE INVENTION

This invention relates to a stair rail section having a generally planar assembly including a hand rail, a shoe rail, and a plurality of spaced balusters having long axes and with their upper ends fastened to a rabbet in the hand rail and their lower ends fastened to a rabbet in the shoe rail, wherein each baluster has its upper end and its lower end fashioned with two intersecting planar faces, the first face being perpendicular to the long axis of the baluster and the second face being at an angle of about 120°–150° to the first face and meeting in an intersection line which is perpendicular to the plane of the stair rail section, the faces on the upper end and the faces on the lower end being oriented as reverse images of each other such that when a baluster is rotated end-for-end the orientation of the two faces is identical. Also, a plastic web is fastened to the rail in the rabbet groove of each rail between the rail and the ends of the balusters; and the web having a plurality of spaced U-shaped flaps with a flap aligned with each baluster end, each flap having a free end and an end joined to the web, the free end of the flap being fastened to the first face of the baluster end adjacent thereto.

The invention also relates to a process for manufacturing an adjustable stair rail planar section having a rabbeted hand rail, a rabbeted shoe rail, and a plurality of spaced balusters fastened at each end respectively to the hand rail rabbet and to the shoe rail rabbet; the method comprising the steps of:

A. fashioning each end of each baluster with two planar surfaces intersecting in a line perpendicular to the plane of the stair rail section; a first face being perpendicular to the long axis of the baluster and a second face being at an angle of 120°–150° to the first face, the two faces at each end of each baluster being oriented such that by rotating the baluster end-for-end the arrangement of the faces is identical;

B. placing the balusters of step A in a flat planar jig which spaces the balusters approximately six inches apart parallel to each other and with ends aligned;

C. attaching to each plurality of baluster ends a plastic web having spaced U-shaped flap aligned with one flap overlying each baluster end, the flap having a free end and a joined end, and stapling the free end to the respective first face of the adjacent baluster end;

D. placing a rabbeted hand rail over the plurality of aligned baluster ends at one end of the baluster, and stapling the web, exclusive of the flaps to the rabbet groove in the hand rail;

E. placing a rabbeted shoe rail over the plurality of aligned baluster ends at the other end of the balusters, and stapling the web, exclusive of the flaps, to the rabbet groove of the shoe rail; and F. removing the assembled stair rail section from the jig.

In a specific preferred embodiment, the plastic web is made of polypropylene and the flaps are integral with the web and are made by making rectangular U-shaped cuts in the web. Also, lines of weakness are provided in the flaps to permit easier bending of the flaps when the rail section is folded into its shipping condition.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
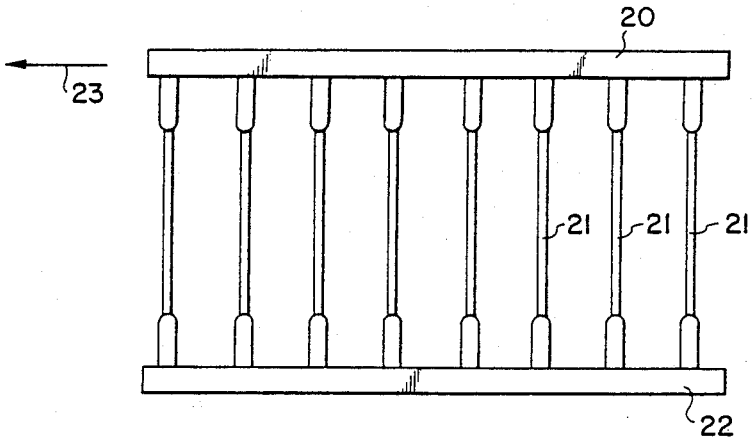
FIG. 1 is a front elevational view of a stair rail section of this invention as it would be installed on a level floor.
Figure 2:
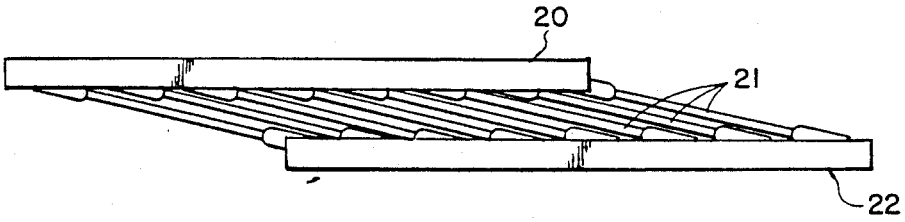
FIG. 2 is a front elevational view of the stair rail section of FIG. 1 in its fully collapsed position.

The invention is best understood by reference to the attached drawings. In FIGS. 1–4 the stair well section of this invention is illustrated in general and in detail. In FIG. 1 there is shown a stair rail section including a hand rail 20, a plurality of spaced parallel balusters 21, and a shoe rail 22 assembled in position to be used on a section of level floor, e.g., on a balcony of the stair. In FIG. 2 the same assembly of FIG. 1 is shown in a collapsed form resulting from pushing hand rail 20 in the direction of arrow 23 while shoe rail 22 is kept in place. Balusters 21 are pivoted at their upper ends where they are attached to hand rail 20 and at their lower ends where they are attached to shoe rail 22. As a result the entire structure can be collapsed until each baluster 21 lies against each adjacent baluster 21 thus preventing any further pivoting. All balusters 21 remain parallel to each other, and the hand rail and shoe rail remain parallel to each other.

Figure 3:
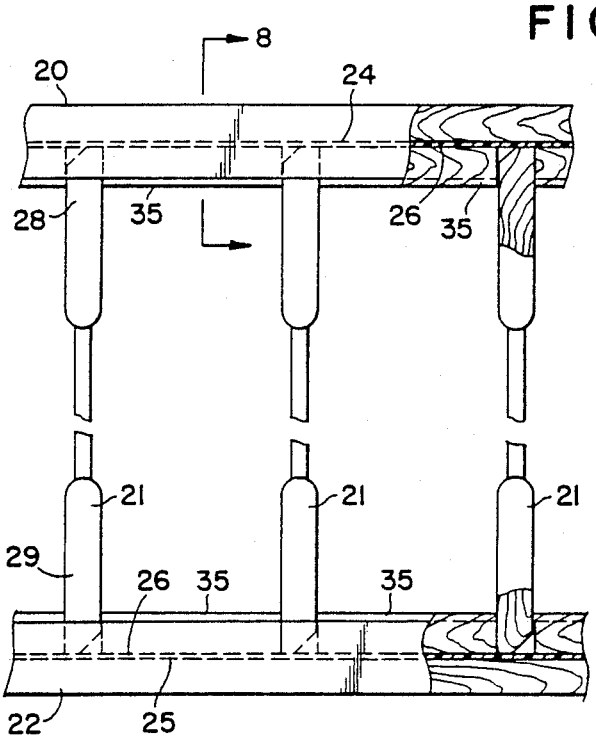
FIG. 3 is an enlarged detailed elevational view, partly in cross section, of a portion of the stair rail section of FIG. 1.
Figure 4:
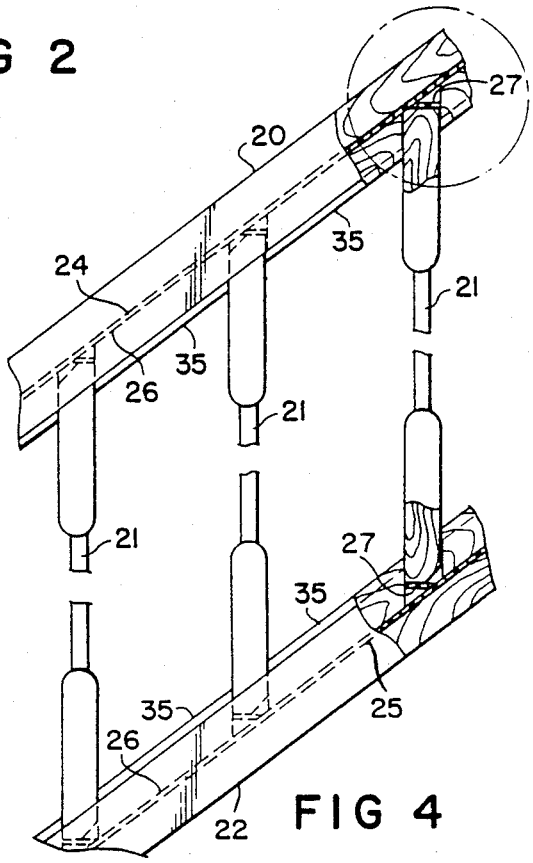
FIG. 4 is an enlarged detailed view of the stair rail section of FIG. 3 adjusted to a flight of stairs.

The detailed structure is shown in FIGS. 3 and 4 which differ from each other only in that the section in FIG. 3 is positioned as it would be on a level floor while the section in FIG. 4 is positioned as it would be when applied to a stair. Hand rail 20 and shoe rail 22 are each formed with a rabbet 24 or 25 of such a width and depth as to accommodate the upper ends 28 and the lower ends 29 of balusters 21. Generally ends 28 and 29 of a baluster are made square or rectangular so as to fit snugly into a linear rabbet 24 or 25 cut into the bottom and top respectively of hand rail 20 and shoe rail 22. It is, of course, not necessary that rabbets 24 and 25 for rails 20 and 22 be identical in size; it is only necessary that each is sized to fit the corresponding ends 28 and 29 of balusters 21.

A plastic web 26, generally the same in width as the width of rabbet 24 or 25, is fastened across the ends 28 and 29, respectively, of balusters 21, before the balusters 21 are inserted into rabbets 24 and 25. After web 26 is appropriately fastened to baluster 21 and to the corresponding rabbet, 24 and 25, the plastic web 26 is sufficiently flexible to bend and this permits balusters 21 to pivot about the connection between the web 26 and the balluster 21 as if there were a hinge there. The performance as a hinge is assured by cutting web 26 where it joins baluster 21 into a U-shaped flap 27 having a free end 40 and a joined end 41. Baluster 21 is attached to the free end 40 of the flap 27, permitting the free end 40 and the baluster 21 to pivot away from the remainder of web 26 without stretching or otherwise disturbing web 26 where it is fastened to rabbet 24 or 25. A detail of this will be seen in FIG. 9.

It is also seen that ends 28 and 29 of each baluster 21 are cut with intersecting planar faces 30 and 31 so as to facilitate the pivoting of baluster 21. Of these two faces, the first face 30 is perpendicular to the axis of the baluster 21; and the second face 31 is cut at an angle of 120°–150°, preferably about 135°, from first face 30. The two faces 30 and 31 are oriented such that the line 32 formed by the intersection of the two planar faces 30 and 31 is generally perpendicular to the plane of the stair rail section, which is also perpendicular to the centerline of rabbet 24 or 25. Intersection line 32 serves as an unfixed pivot line for the pivoting of baluster 21, and as such it is generally perpendicular to the plane in which baluster 21 pivots, which plane also includes the centerline of rabbet 24 or 25. Intersection line 32 generally also intersects the central axis of baluster 21 so that faces 30 and 31 are approximately equal in area.

Figure 5:
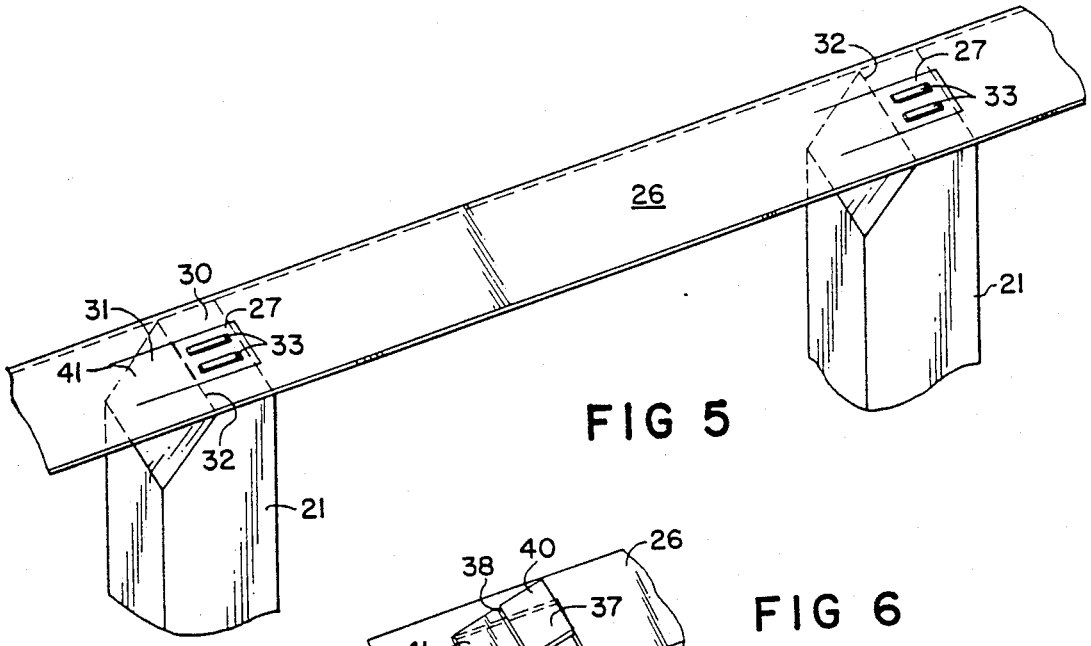
FIG. 5 is a perspective view of the assembly of balusters to the plastic web of this invention.
Figure 6:
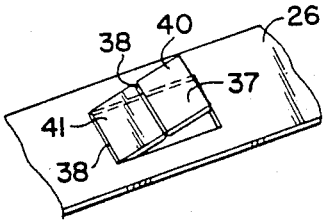
FIG. 6 is a perspective view of a second embodiment of the plastic web and flaps of this invention.
Figure 7:
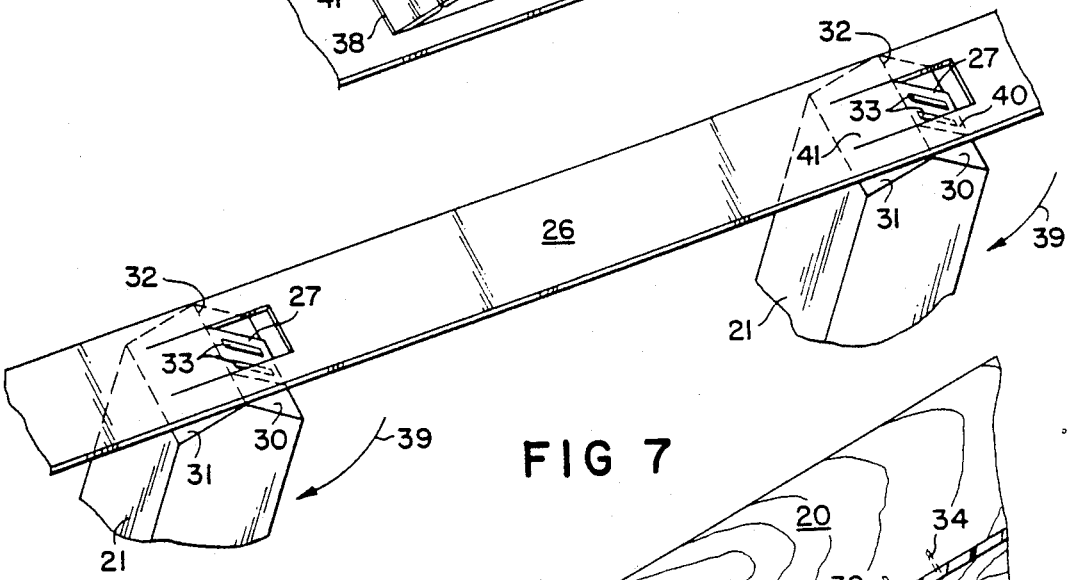
FIG. 7 is a perspective view of the assembly of FIG. 5 illustrating how the balusters may be pivoted to any position.

FIGS. 5–7 illustrate the plastic web 26, flaps 27, and the attachment of flaps 27 to balusters 21. It will be seen that the lateral width of plastic web 26 is substantially equal to the lateral width of balusters 21. Spaced at lengthwise intervals identical to the spaces between balusters 21 are cut portions forming flaps 27 generally aligned along the lengthwise centerline of web 26. The cut portions are generally in the shape of the letter V, although preferably it is a rectangular V. Such a cut produces a flap 27 which is joined to web 26 at the joined end 41 of flap 27 and has a free end 40 not connected to web 26. Free end 40 is attached to first face 30 of the baluster 21 adjacent thereto. With each baluster 21 fastened to the free end 40 of a flap 27 it will be seen that each baluster 21 is pivotable in the direction of arrow 39 about intersection line 32 or about a line through joined end 41 parallel to intersection line 32 depending on how far balusters 21 are pivoted in the direction of arrows 39. Free end 40 may be fastened to first face 30 by any convenient mean including staples, nails, screws, cement, or the like. In FIGS. 5 and 7 the attachment is made by staples 33. The embodiment of FIG. 6 generally shows a flap 37 similar in all respects to flaps 27 in FIGS. 5 and 7 except that flap 37 is provided with two lines of weakness in the form of fold lines 38 may be made by pressing a tool against web 26 to form weakened lines 38 which will bend more easily than areas not having weakened lines, and thereby predetermine where the fold occurs when baluster 21 is pivoted. The fold line 38 aligned with the edge of tab 37 connected to web 26 reduces the amount of bulging of the adjacent web portions when the rail section is completely folded as shown in FIG. 2. Web 26 preferably is made of a polyolefin; especially desirable is polypropylene. There is no criticality as to the exact size of flaps 27 nor the exact size of web 26. A typical web 26 is about 1.25 inches wide or slightly smaller so as to fit easily and yet snugly in a rabbet having a width of 1.25 inches. Flaps 24 typically are about 0.625 inch wide and about 1.25 inches long. Web 26 preferably is about 0.100 inch thick to provide the necessary strength. Spaces between adjacent flaps 27 are the same as spaces between adjacent balusters 21 which normally is about 6 inches.

Figure 8:
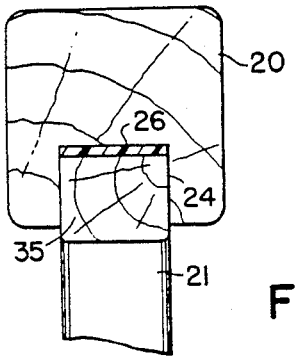
FIG. 8 is a cross sectional view taken at 8—8 of FIG. 3.
Figure 9:
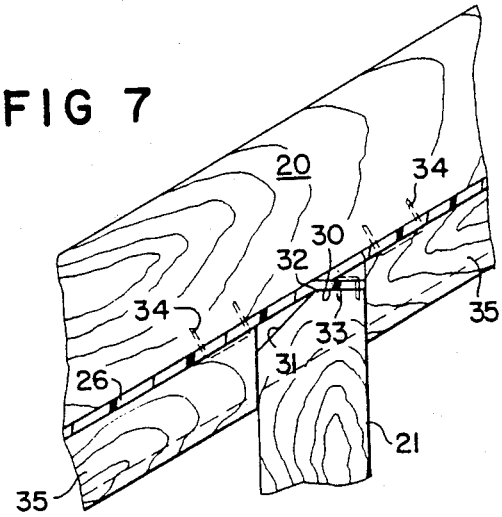
FIG. 9 is an enlarged cross sectional view of the portion encircled in FIG. 4.

In FIGS. 8 and 9 there are cross sectional views to show the details of the finished stair rail section. Hand rail 20 has a rabbet 24 of sufficient width to receive baluster 21 topped with web 26. After the balusters 21 and web 26 are connected to rabbet 24 by staples 34 on opposite sides of and closely adjacent each balluster 21 a fillet 35 is inserted between adjacent balusters 21 and fixed in place by nails, screws, glue, or the like to cover the open rabbet between adjacent balusters 21. When the assembly of balusters 21 and web 26 (as shown in FIGS. 5 and 7) is inserted into rabbet 24, web 26 is then connected on opposite sides of each baluster 21 and closely adjacent thereto by staples 34 to the bottom of rabbet 24 in hand rail 20 to fasten web 26 tightly to hand rail 20. Fillets 35 are then fastened in place between adjacent balusters 21 FIG. 9 shows the general positions of the various components of the stair rail section when it is used on a stairway having a pitch of about 30°–35°.

Figure 10:
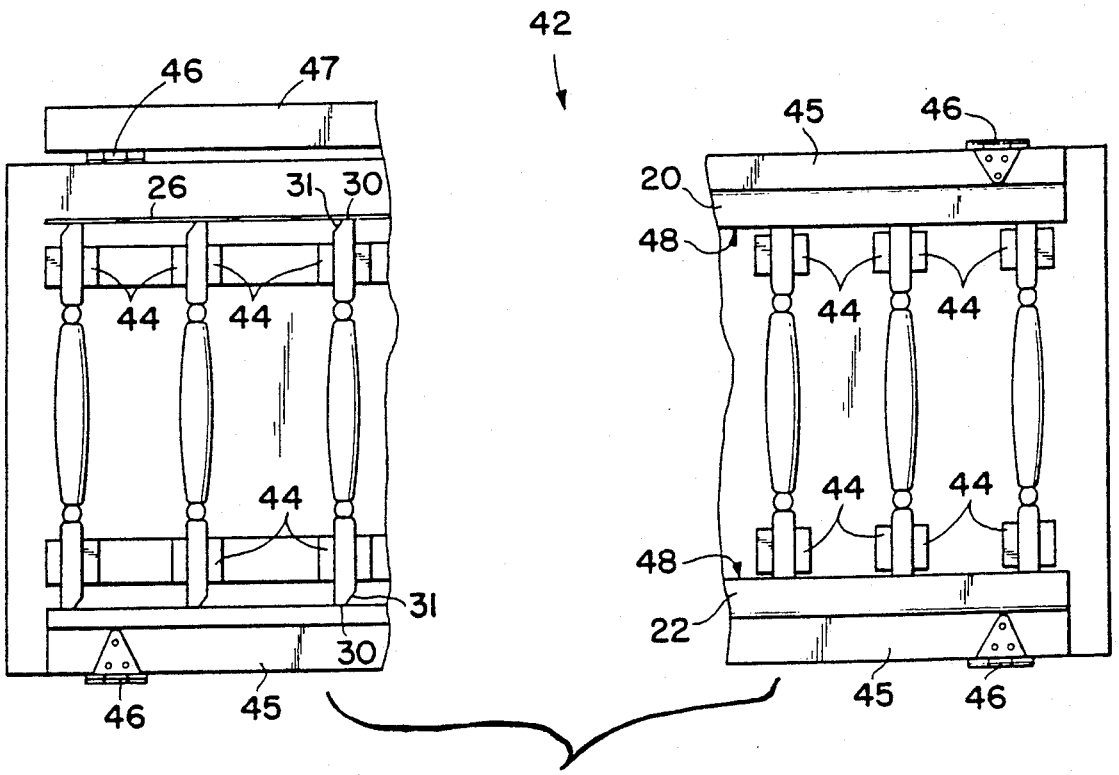
FIG. 10 is a top plan view of a jig used in the process of this invention.
Figure 11:
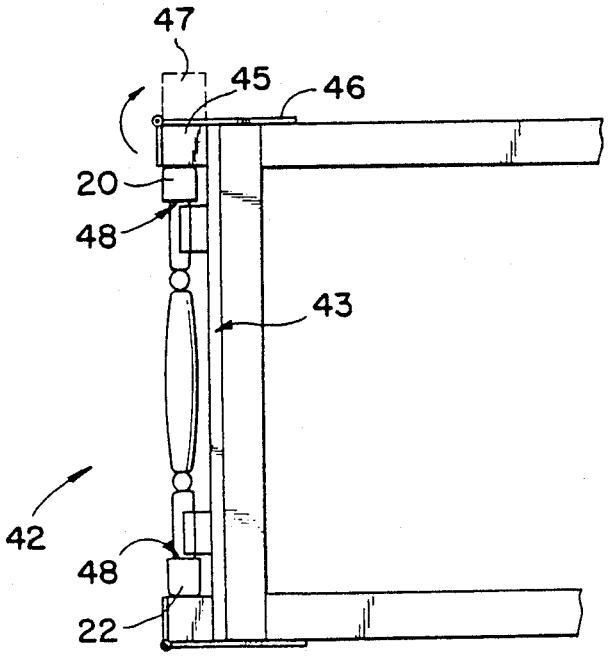
FIG. 11 is an end elevational view of the jig of FIG. 10.

The process of manufacturing the stair rail section of this invention involves the use of a jig 42 which is shown in FIGS. 10 and 11 although other jigs may be used that are well known in the cabinet-making art. The jig 42 is a table with a horizontal planar top 43 on which are a plurality of cleats 44 adapted to position balusters 21 in predetermined spaced locations. Hinged clamping members 45 may be moved into place by pivoting around hinge 46 when needed or pivoted out of the way as shown at 49, when not needed. Balusters 21 have previously been fashioned with a first face 30 and a second face 31 at each upper end 28 and each lower end 29. The orientation of faces 30 and 31 is such that each end 28 or 29 is a reverse mirror image of the other end 29 or 28. By this it is meant that when the baluster 21 is rotated end-for-end the orientation of faces 30 and 31 is identical, i.e., either end may be used as upper end 28 in hand rail 20 or lower end 29 in shoe rail 22.

After balusters 21 are fixed in place in jig 42, a length of web 26 with flaps 27 cut therein, is stretched across the upper ends 28 and staples 33 are employed to fasten free ends 40 of flaps 27 to first faces 30 of balusters 21. Similarly, a second length of web 26 with flaps 27 cut therein is stretched across lower ends 29 of balusters and fastened in place by staples 33 through free ends 40 into first faces 30. The assembly of balusters 21 and webs 26 is then capped at each end with hand rail 20 and shoe rail 22, respectively. Staples 34 are then employed to fasten web 26, between adjacent flaps 27, to the bottom of rabbet 24 and 25 respectively, as indicated generally at arrows 48 in FIGS. 10 and 11. It is preferred to apply staples 34 close to the perimeters of flaps 27 so as to permit the proper pivoting of balusters 21 without any wrinkling or other movement of web 26 in rabbet 24 or 25. The stair rail section is then ready to be placed on the stair and be fixed at each end by fastening the hand rail 20 and the shoe rail 22 to a wall, a newell post, or the like. Typically, each hand rail 20 and shoe rail 22 is attached to a newell post or a wall by the use of a claw fixture well known in this art and disclosed in U.S. Pat. No. 4,421,302. After the stair rail is fixed in place, fillets 35 are cut to fit between adjacent balusters 21 and fastened in place by nails, screws, glue, or the like. It will be appreciated that the stair rail section as described above is capable of being used for stairs of any pitch. No custom manufacturing is required, except to cut and trim the fillets 35 after the stair rail is in place.

While the staples 33 and 34 are shown in FIGS. 5, 7 and 9 with their longitudinal axis extending in the same direction as the length of strap 26, it is to be understood that such staples may be disposed perpendicular to such direction. An advantage to staples 33 extending closely adjacent the free edge and line 32 would be to provide a more tear resistance of the plastic strap, for example. With respect to staples 34, they may provide better stabilization of the plastic web 26 by being placed closer to the baluster 21, i.e., to inhibit bulging of the web 26.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the U.S. is:

1. In a stair rail section comprising a generally planar assembly of a hand rail, a shoe rail, and a plurality of spaced balusters having long axes and with their upper ends fastened to a rabbet in the hand rail and their lower ends fastened to a rabbet in the shoe rail; the improvement wherein each baluster has its upper end and its lower end fashioned with two intersecting planar faces, the first face being perpendicular to the long axis of the baluster and the second face being at an angle of about 120°-150° to the first face and meeting in an intersection line which is perpendicular to the plane of the stair rail section, the faces on the upper end and the faces on the lower end being oriented as reverse images of each other such that when a baluster is rotated end-for-end the orientation of the two faces is identical and wherein a plastic web is fastened to the rail in the rabbet groove of each rail between the rail and the ends of the balusters; a plurality of spaced U-shaped flaps in the web with a flap aligned with each baluster end, each flap having a free end and an end joined to the web, the free end of the flap being fastened to the first face of the baluster end adjacent thereto.

2. The stair rail section of claim 1 wherein the free end of each flap is fastened by staples to the first face of the corresponding end of the baluster, and the web adjacent to the flap is stapled to the rabbet groove in the adjacent rail.

3. The stair rail section of claim 1 wherein the length of each flap corresponds approximately to the length of the first face plus the length of the second face measured perpendicular to said intersecting line.

4. The stair rail section of claim 1 which is collapsible by causing each flap to fold across its joined end to cause the balusters to lie against each other with the hand rail and the shoe rail adjacently parallel to each other.

5. A method of manufacturing a generally planar adjustable stair rail section having a rabbeted hand rail, a rabbeted shoe rail, and a plurality of spaced balusters fastened at each end respectively to said hand rail rabbet and to said shoe rail rabbet the method comprising:

A. fashioning each end of each baluster with two planar surfaces intersecting in a line perpendicular to the plane of the stair rail section; a first face being perpendicular to the long axis of the baluster and a second face being at an angle of 120°-150° to the first face, the two faces at each end of each baluster being oriented such that by rotating the baluster end-for-end the arrangement of the faces is identical;

B. placing the balusters of step A in a flat planar jig which spaces the balusters approximately six inches apart parallel to each other and with ends aligned;

C. attached to each plurality of baluster ends a plastic web having spaced U-shaped flaps aligned with one flap overlying each baluster end, the flap having a free end and a joined end, and stapling the free end to the respective first face of the adjacent baluster end;

D. placing a rabbeted hand rail over the plurality of aligned baluster ends at one end of the baluster, and stapling the web, exclusive of the flaps to the rabbet groove in the hand rail;

E. placing a rabbeted shoe rail over the plurality of aligned baluster ends at the other end of the balusters, and stapling the web, exclusive of the flaps, to the rabbet groove of the shoe rail; and F. removing the assembled stair rail section from said jig.

6. The method of claim 5 wherein said U-shaped flaps are integral parts of said web, each flap resulting from a rectangular U-shaped cut in the web.

7. The method of claim 5 wherein said web is a polyolefinic material.

8. The method of claim 7 wherein said web is polypropylene.

9. In a collapsible stair rail section comprising a generally planar assembly of an elongated hand rail, an elongated shoe rail, and a plurality of spaced balusters having substantially parallel longitudinal axes and with their upper ends fastened to a rabbet in the hand rail and their lower ends fastened to another rabbet in the shoe rail; the improvement wherein each baluster has its said upper end and its said lower end formed from at least two intersecting planar faces, a first of said faces being perpendicular to its longitudinal axis of each said baluster and a second of said faces being at an angle of about 120°-150° to said first face and meeting in an intersection line which is perpendicular to a plane of said stair rail section, said faces on said upper end and said faces on said lower end being oriented as reverse images of each other such that when one of said ballusters is rotated end-for-end the orientation of said two faces is identical, said rail section further comprising a plastic web fastened to respective said rail in respective said rabbet groove between respective said rail and respective said ends of said balusters, said plastic web including a plurality of spaced U-shaped flaps with respective said flap aligned with each said baluster end, each flap having a free end and an edge joined to said web, said free end of each said flap being fastened to said first face of its aligned said baluster end.

10. The collapsible stair rail section of claim 9 further comprising staples to fasten said first face of the corresponding end of each said baluster, and other staples to connect said web adjacent to respective said flap to respective said rabbet groove in respective said rail, said other staples being located closely adjacent to and on opposite sides of respective said baluster.

11. The collapsible stair rail section of claim 9 wherein each said flap has a length which corresponds approximately to a length of said first face plus a length of said second face measured perpendicular to said intersection line.

12. The collapsible stair rail section of claim 9 wherein each said flap includes a line of weakness extending along and aligned with said intersection line of respective said baluster end connected to said flap.

13. The collapsible stair rail section of claim 12 wherein each said flap includes another line of weakness extending substantially parallel to said line of weakness and extending along and aligned with respective said edge of said flap thereby minimizing bending forces on said flap and web when said rail section is in its fully collapsed condition.

14. The collapsible stair rail section of claim 9 wherein each said flap includes a line of weakness extending along and aligned with respective said edge of said flap.

15. The collapsible stair rail section of claim 9 wherein each said web is elongated and extends substantially the length of each of said hand and shoe rails.

16. A method of manufacturing a generally planar adjustable and collapsible stair rail section having an elongated rabbeted hand rail, an elongated rabbeted shoe rail, and a plurality of spaced balusters fastened at each end respectively to said hand rail rabbet and to said shoe rail rabbet; the method comprising the steps of:

A. making each end of each baluster with two planar surfaces intersecting in a line perpendicular to the plane of the stair rail section with a first face being perpendicular to the longitudinal axis of the baluster and a second face being at an angle of 120°-150° to the first face, the two faces at the respective end of each baluster being oriented such that by rotating the baluster end-for-end the disposition of the respective faces is identical;

B. placing the balusters of step A in a substantially horizontal and planar jig which spaces the balusters approximately six inches apart parallel to each other and with ends aligned;

C. attaching to each of the baluster ends a plastic web having spaced U-shaped flaps respectively aligned with a flap overlying each baluster end by stapling its free end to the respective first face of the adjacent baluster end;

D. placing a rabbeted hand rail over the plurality of aligned baluster ends at one end of the baluster, and stapling the web, exclusive of the flaps, to the rabbet groove in the hand rail;

E. placing a rabbeted shoe rail over the plurality of aligned baluster ends at the other end of the balusters, and stapling the web, exclusive of the flaps, to the rabbet groove of the shoe rail; and F. removing the assembled stair rail section from the jig.

17. The method of claim 16 further comprising the following step:

G. precutting the U-shaped flaps spacedly along an elongated web substantially the same length of each of the rails prior to step C.

18. The method of claim 16 wherein step D includes the following step:

G. positioning the staples on and closely adjacent opposite sides of each baluster along the length of the web.

19. The method of claim 16 further comprising the following step:

G. providing a line of weakness of each flap in alignment with the intersection of the two faces on the adjacent baluster end 20. The method of claim 16 further comprising the following step:

G. providing a line of weakness on each flap along its connection to the web opposite to and spaced from the free end of each flap.

* * * * *